United States Patent [19]

König et al.

[11] Patent Number: 4,977,331

[45] Date of Patent: Dec. 11, 1990

[54] METHOD OF AND APPARATUS FOR DETECTING THE DEGREE OF FILLING OF SUPPLY SPOOLS ON A SPINNING OR TWISTING FRAME

[75] Inventors: Herbert König, Ebersbach/Fils; Friedrich Dinkelmann, Rechberghausen, both of Fed. Rep. of Germany

[73] Assignee: Zinser Textilmaschinen GmbH, Ebersbach/Fils, Fed. Rep. of Germany

[21] Appl. No.: 892,719

[22] Filed: Jul. 31, 1986

[30] Foreign Application Priority Data

Jul. 31, 1985 [DE] Fed. Rep. of Germany ..... 3527473

[51] Int. Cl.[5] ..... G01N 21/86

[52] U.S. Cl. ..... 250/560; 356/387

[58] Field of Search ..... 356/384, 385, 386, 387, 356/429; 250/560, 571, 223 R; 242/28

[56] References Cited

U.S. PATENT DOCUMENTS

| | | | |
|---|---|---|---|
| 3,505,530 | 4/1970 | Reynolds et al. | 242/28 |
| 3,619,628 | 11/1971 | Whitney . | |
| 3,922,094 | 11/1975 | Colding et al. | 356/384 |
| 4,037,103 | 7/1977 | Ryden Jr. | 250/560 |
| 4,120,403 | 10/1978 | Stephanos | 250/560 |
| 4,648,718 | 3/1987 | Sadamitsu et al. | 250/560 |

FOREIGN PATENT DOCUMENTS 2056577 11/1969 Fed. Rep. of Germany .

*Primary Examiner*—David C. Nelms

*Attorney, Agent, or Firm*—Herbert Dubno

[57] ABSTRACT

Spool change in a spinning and twisting frame is triggered automatically by repetitively monitoring a row of spools with a light curtain and triggering the spool change when the measured diameter falls below the predetermined minimum value.

14 Claims, 5 Drawing Sheets

METHOD OF AND APPARATUS FOR DETECTING THE DEGREE OF FILLING OF SUPPLY SPOOLS ON A SPINNING OR TWISTING FRAME

FIELD OF THE INVENTION

Our present invention relates to a method of and to an apparatus for detecting the degree of filling of the supply spools of a spinning or twisting frame and, more particularly, to an improvement in textile machinery which allows an array of yarn supply spools or the like to be monitored so that when these spools are emptied they can be changed.

BACKGROUND OF THE INVENTION

In modern textile machinery of the aforedescribed type, especially spinning and twisting frames provided with rows of supply spools, it is known to trigger an automatic spool change by monitoring the degree of filling of a spool.

In a ring-spinning machine, for example, the actual weight and the estimated running time of each individual supply spool is determined and the point in time at which each spool is expected to run out can be established (see German patent document-open application No. DE-OS 32 16 218) and this information used to initiate an automatic replacement of the empty supply spool.

While such systems certainly represent an improvement over the operator's surveillance of the supply of spools and the manual initiation of a spool replacement operation when the operator detects an empty supply spool, they are characterized by high cost for the installation and operation of the monitoring systems because a respective monitoring device must be provided for each spool.

OBJECTS OF THE INVENTION

It is, therefore, the principal object of the present invention to provide an improved method of detecting the degree of filling of the supply spools of a spinning or twisting machine having rows of such spools which simplifies the operation and nevertheless enables the detection to be made for each supply spool with the drawbacks of the prior systems mentioned above.

Still another object of this invention is to provide an improved apparatus for determining the degree of filling of the supply spools of textile machines, especially a spinning or twisting frame.

SUMMARY OF THE INVENTION

These objects and others which will become apparent hereinafter are attained, in accordance with the present invention by a method in which the diameters of the supply spools of each row are repetitively detected in succession utilizing a detector common at least to a number of supply spools along a row, with each detected diameter value being then compared to a predetermined minimum diameter value such that, when the measured diameter lies beneath this minimum diameter value for a monitored supply spool, an appropriate signal is generated which can be utilized to alert an operator to initiate automatic spool replacement or in some other way is conducive to the return of operation at the particular station.

This provides the advantage of a simple process with a single unit scanning a number of spools, this unit evaluating each spool only briefly so that an entire row of spools can be scanned often and repetitively so that empty spools are readily detected and an appropriate evaluatable signal is generated.

The sensing can be effected optoelectronically, for example, by providing a light curtain which is directed across the spool orthogonal to its axis and is moved along a row of spools transversely to the direction in which the light curtain extends and, advantageously, perpendicular to the axes of the spools. The parameter of the interruption of the light curtain which is evaluated for each spool can be the duration of the interruption for a given velocity of movement of the light curtain or the extent of the displacement of the light curtain during this interruption.

More particularly, the method of the invention can comprise (a) repetitively sensing the diameters of a plurality of the spools in succession;

(b) upon the sensing of the diameter of each spool, comparing the diameter sensed with a predetermined minimum-diameter value; and (c) generating a signal representing the need to replace a given spool in response to the comparison of the diameter sensed with the predetermined minimum-diameter value when the sensed diameter falls below the predetermined minimum-diameter value.

As noted the sensing of the diameters of the spools in step (a) can be effected optoelectronically. Specifically the sensing of the diameters of the spools can be effected by moving a light curtain which is interrupted by the spools in succession past the spools in a direction perpendicular to the axes of the spools.

The diameters of the spools can be measured in detection of the diameters by the interruption of the light curtain by monitoring the duration of the interruption while moving the light curtain past the spools at a given speed.

Alternatively the diameters of the spools are measured in detection of the diameters by the interruption of the light curtain by monitoring the extent of the displacement of the light curtain during each interruption.

The apparatus for detecting the degree of filling of supply spools in a spinning or twisting frame can comprise:

means for repetitively sensing the diameters of a plurality of the spools in succession;

means for comparing the diameter of each spool sensed with a predetermined minimum-diameter value; and means for generating a signal representing the need to replace a given spool in response to the comparison of the diameter sensed with the predetermined minimum-diameter value when the sensed diameter falls below the predetermined minimum-diameter value.

Advantageously in one embodiment the means for repetitively sensing the diameters of each spool sensed comprises:

a light curtain positioned to be interrupted by the supply spools, means for moving the light curtain in a direction transverse to the axes of the spools at a given speed whereby the light curtain is interrupted by the spools in succession, and a timing circuit connected to the light curtain and responsive to the interruption of the light curtain.

The means for comparing can include a comparison circuit connected to the timing circuit.

The timing circuit can be constructed and arranged to trigger upon detection of a leading flank of an interruption of the light curtain to generate a setpoint time interval, the comparison circuit being connected to the light curtain to produce the signal when the duration of the interruption is less than the setpoint time interval.

In another embodiment the means for repetitively sensing the diameters of each spool sensed comprises:

a light curtain positioned to be interrupted by the supply spools, means for moving the light curtain in a direction transverse to the axes of the spools whereby the light curtain is interrupted by the spools in succession, and circuit means for measuring the displacement of the light curtain during each interruption, Here, the means for comparing also includes a comparison circuit connected to the circuit means.

This circuit means and the light curtain can be connected to a flip-flop.

Alternatively a plurality of rows of the spools are provided on the frame and the spools of the rows are arranged to be changed in sections of rows, a respective light curtain being provided for each of the sections.

The transport element can be a belt guided on a rail fixed along a respective row of the spools.

When the transport element comprises at least two belts one of which carries a photocell and another of which carries a light source of the light curtain, the belts can pass around a common drive wheel and can be form-locked together.

Advantageously the belts are perforated and the wheel has pins passing through holes in the belts.

The belt can pass around a drive wheel formed with a cam generating a pulse which is applied to the means for comparing.

The means for comparing can include an address generator, a comparator and and a position generator in circuit with one another.

A "light curtain", as this term is used herein, will be understood to constitute a light source, the beam projected by that source, and a photodetector or photocell responsive to the light beam and so positioned so as to be directly opposite to the source or otherwise disposed with respect to a reflector as to respond to the interruptions of the light beam as the light curtain is moved along a row of the supply spools.

BRIEF DESCRIPTION OF THE DRAWINGS

The above and other objects, features and advantages of the present invention will become more readily apparent from the following description, reference being made to the accompanying drawing in which.

SPECIFIC DESCRIPTION

Figure 1:
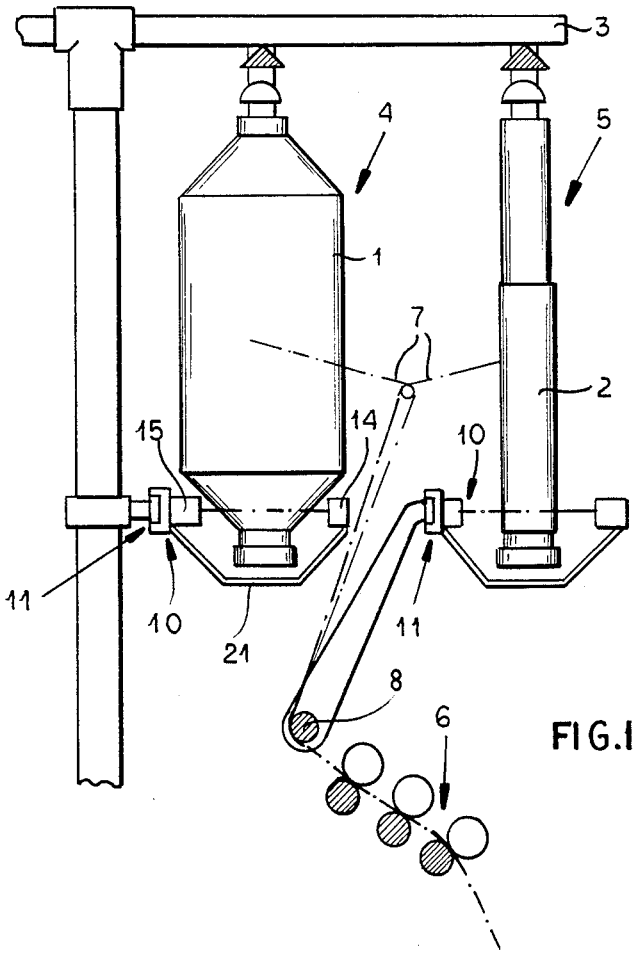
FIG. 1 is a schematic side elevational view showing the use of a light curtain to monitor supply spools in two rows of a spinning or twisting frame according to the invention.

FIG. 1 represents in highly diagrammatic form and from the side, one of the stations of a spinning or twisting machine which can have, as diagrammatically illustrated, two supply spools 1 and 2 for each spinning or twisting station. The spinning or twisting frame 3 is of the ring-spinning type. The rovings 7 drawn from the supply spools 1, 2, pass through a common eye and then enter the drafting frame 6.

The degree of filling of the supply spools 1 and 2 can be sensed by light curtains 10 of which two are shown here, each assigned to one of the rows of spools, the spools being arrayed one behind the other in the longitudinal direction of the frame, i.e. perpendicular to the plane of the paper in FIG. 1.

The light curtains 10 are carried by transport elements which are represented very generally at 11 and are shown to move along the row of supply spools 1 and 2 of the frame, either on the drawing frame itself or upon a support bar 8 of the drafting unit 6.

In this manner, all of the supply spools of each row are optically monitored one after another so that as the supply spool approaches an empty condition, the sensed diameter, i.e. the diameter detected by a respective light curtain, will trigger an evaluatable signal at the point at which the detected diameter falls below a predetermined minimum diameter.

As will be developed in greater detail later, the diameter of the spool can be measured by monitoring the duration of the interruption of the light curtain 10 by the movement of the light curtain past each spool at a given speed.

However, it is also possible and as will also be discussed below, to monitor the advance of the light curtain during the interruption thereof as a measure of the degree of filling of each supply spool 1 or 2.

Figure 2:
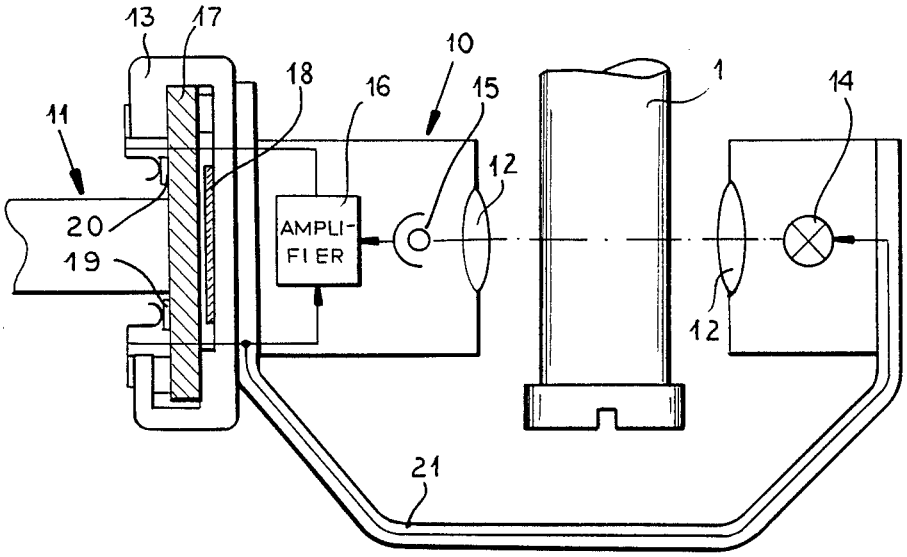
FIG. 2 is an enlarged elevation in highly diagrammatic form and purely in section, showing the principles of the invention.

As can be seen from FIG. 2, each light curtain 10 can include a light source or lamp 14, e.g. a light-emitting diode, a laser diode or an incandescent lamp or glow tube.

The lamp 14 is juxtaposed with a photocell 15 and the light curtain can also include optical systems 12 for collimating or bundling the light rays to form a slender light pencil. The light curtain also includes an amplifier 16 connected to the photocell 15.

In the embodiments of FIGS. 1–3 and 7, the light source 14 and the photocell 15 are interconnected by a yoke to one another and form a unit which is guided via a slide shoe on a stationary rail 17 and can be connected with an endless belt 18, for example, a steel belt, passing over rollers and one of which may be driven so that the unit 14, 15, 21 can be displaced along one of the rows 4 or 5 of supply spools as illustrated in FIG. 1.

The belt 18 passes over two deflection rollers 22 at the opposite ends of the textile machine frame and one of these rollers, as represented at 22', can be driven by the motor 30.

Because of the nature of the yoke 21 and the path of the roving as it is unwound from the spools, the light curtains, 10 can only be provided in the region of the lower winding cones of the supply spools.

As can be seen from FIG. 2, the rail 17 extends along the rows of spindles for the spools 1,2 and orthogonal to the axes thereof, carries a pair of contact rails 19 and 20 which are insulated from one another and are electrically conductive to supply electrical energy to the light curtain 10 and conducting signals from this light curtain to a central station for evaluation. The light curtain is here represented by the source or lamp supplied by the rails 19 and 20, the lenses representing the optical systems 12, the photocell 15 and its amplifier 16.

The slide or carriage 13 bearing the light curtain is provided with brushes represented diagrammatically at 19', 20' engaging the rails.

The carriage 13 is displaced by a metallic belt 18 affixed to this carriage so that either the rail 17 or the belt 18 can function as a return path for the electrical conductors 19 and 20.

Generally the supply spools, 1, 2 are provided in a plurality of parallel rows in the spinning or twisting machine frame, usually in two such rows but for each of these rows, a single light curtain 20 can be provided or a respective light curtain can be provided for part of a row or for only one row on each side of the frame or even for only one row of the frame.

In so-called wild replacement, i.e. the mode of operation in which each empty supply spool is individually replaced, it serves to reason that each supply spool must be individually monitored, and hence each row 4 or 5 must have a respective light curtain.

By contrast, when supply spools are intended to be replaced sectionwise on both rows simultaneously, it suffices to supply a single light curtain for one of these two rows 4 and 5 so that the supply spools of a section of both rows will be replaced when monitoring of the spools of one row shows that the roving has been fully unwound.

Figure 3:
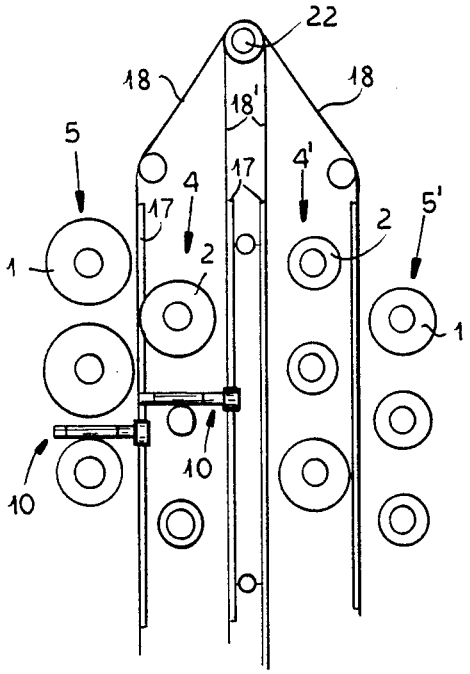
FIGS. 3–5 are plan views in highly diagrammatic form illustrating various embodiments of the means for displacing the light curtains in association with the machine.

In the embodiment of FIG. 3, each supply spool row is provided with a respective light curtain 10 displaced by a respective belt 18, 18'.

Such an arrangement has been found to be desirable when the machine is provided with roving-stop devices for the respective stations. In this case the supply spools can be mounted at different times and feed can be stopped at different times.

Figure 4:
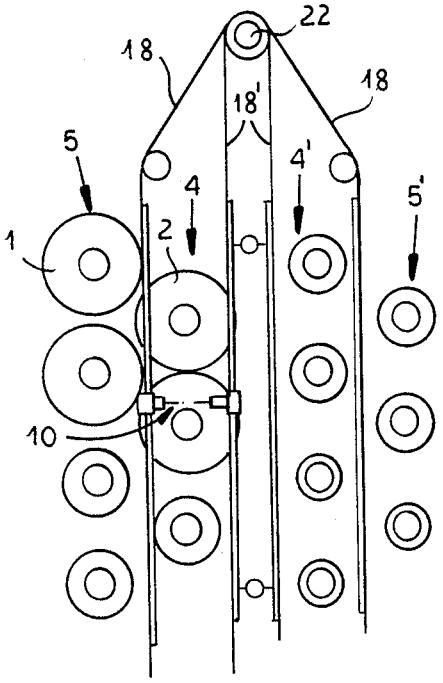

In the embodiment of FIG. 4, only the one row of spools on each side of the frame is monitored and in this case it is not necessary to connect the light source 14 and the photocell 15 by a yoke as was shown in 21 previously, but the photocell can be mounted on the belt 18' while the light source is mounted on the belt 18 and the two belts are displaced synchronously with one another by causing them to pass over a common drive wheel 22. Synchronization is ensured by forming the bands or belts 18, 18' with perforations so that pins **22*a* of the wheel 22** can pass simultaneously through registering perforations in the two belts, assuring their constant alignment.

Similar pins **22*a* are provided for the wheel 22 driving the belts 18', 18'' synchronously with the belt 18**.

In this embodiment the two rows 4 and 5 of supply spools on each side of the machine are monitored and the intermediate belt 18 can carry both sources or lamps 14 of the two light curtains, each of which has a respective photo cell 15 on the respective other belt 18' and 18''. Here as well the belts are perforated for synchronism.

Figure 5:
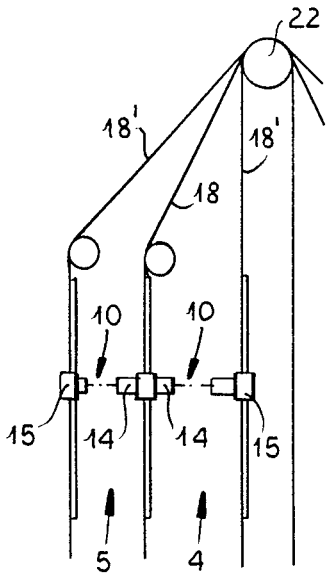
Figure 6:
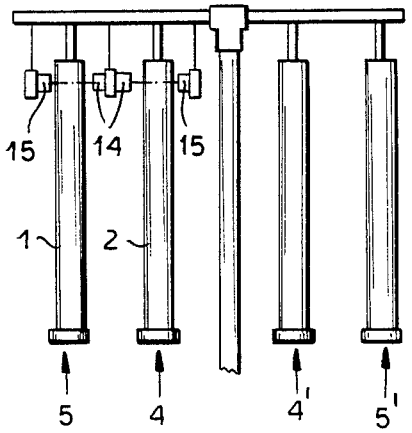
FIG. 6 is a schematic elevation showing the embodiment of FIG. 5 from a side.

Because the embodiments of FIGS. 4–6 eliminate the yoke 21 between the two parts of each light curtain, i.e. the light source 14 and the photocell, these light curtains can be disposed at any point over the height of the supply spool, e.g. even in the region of the upper winding cone thereof.

Figure 7:
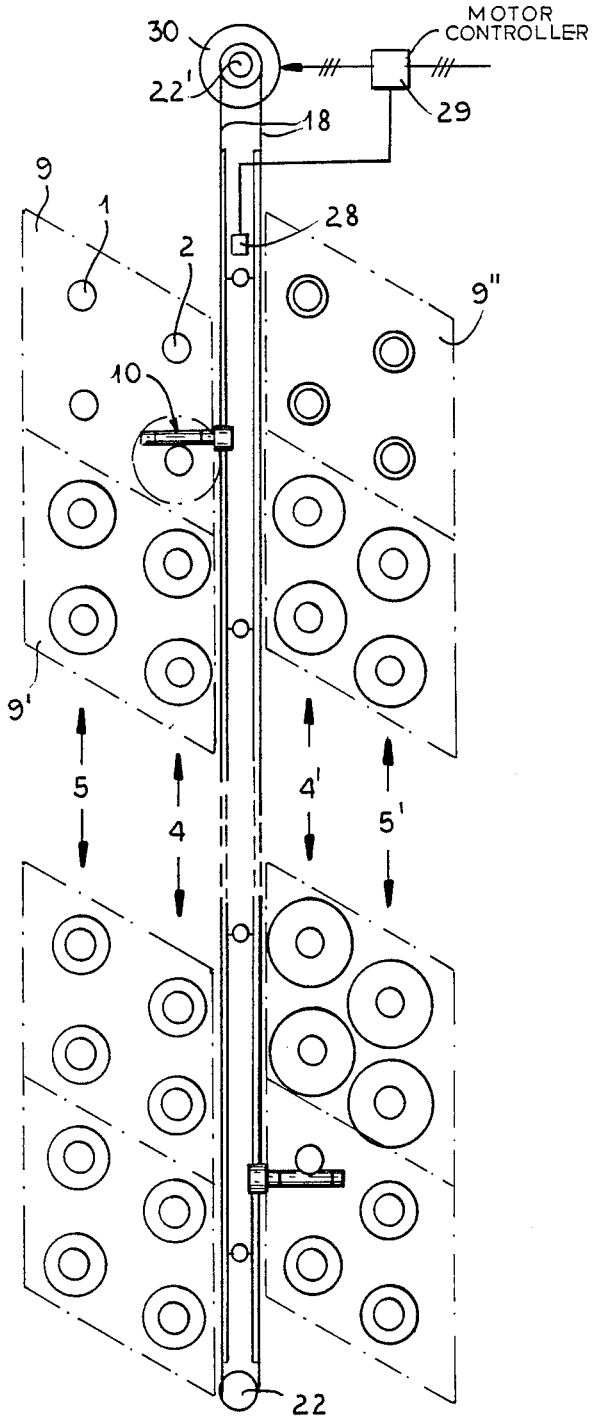
FIG. 7 is yet another diagrammatic plan view similar to FIGS. 3–5 of another embodiment of the invention.

In the embodiment of FIG. 7, only one belt 18 is used and serves to displace the two light curtains 10 on opposite sides of the machine frame, the light curtains on each side scanning only one row of spools thereof. As with the spools 18, 18', 18'' of the previous embodiments, the belt here serves to displace the light curtains 10 on opposite sides of the machine alternatively in opposite directions. At an end of the path along the respective row, the sensor 28 is provided which responds to one of the light curtains 10 and, via a motor controller 29, causes reversal of the motor 30 driving the wheel 22'. Consequently, the rows which are monitored are scanned repeatedly by the back and forth movement of the respective light curtains.

This single row monitoring on each side of the machine signifies that the spools of the other row 5, for example, should be changed at least in part in sections in conjunction with corresponding spools of the row 4. The sections in which the spools are changed simultaneously have been represented in dot-dash lines at 9, 9', 9''. Each set of spools of a given section is changed when the corresponding spools of row 4 have been found to have been emptied.

Figure 8:
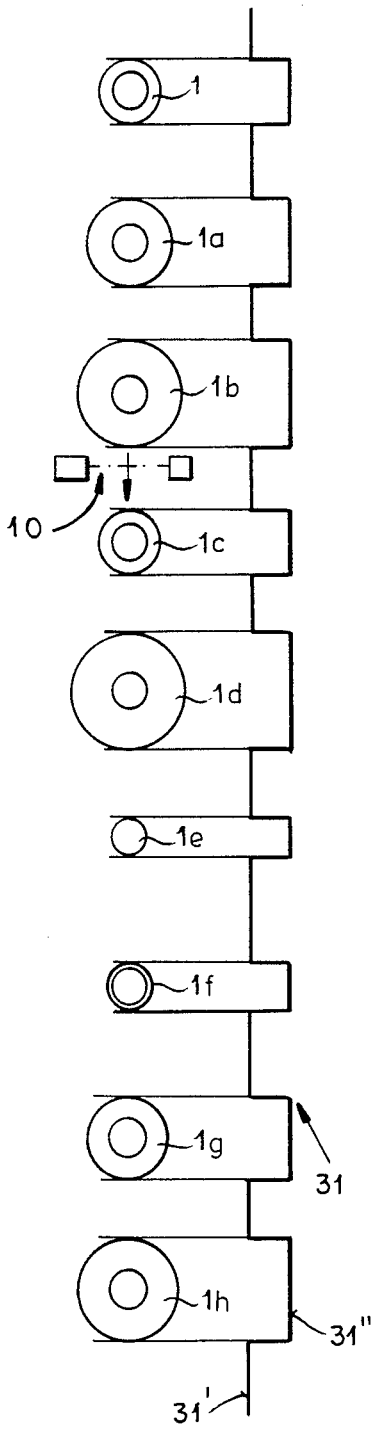
FIG. 8 is a diagram showing the run-out phase of spools of the spinning or twisting machine.

FIG. 8 shows graphically the monitoring of a row of spools 1, **1*a* . . . 1*h* with different degrees of filling by a light curtain 10 moved therealong. The line segments 31' correspond to light continuity of the curtain while the segments 31''** indicate the interruptions which signify the diameters of the spools. Note that the lengths of the line segments decrease as the diameters are reduced.

Figure 10:
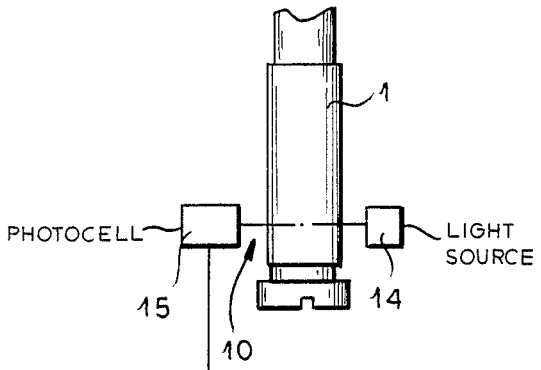
FIG. 10 is a pulse diagram illustrating principles of the operation thereof.
Figure 10:
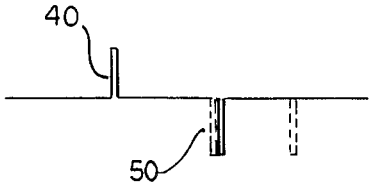
Figure 9:
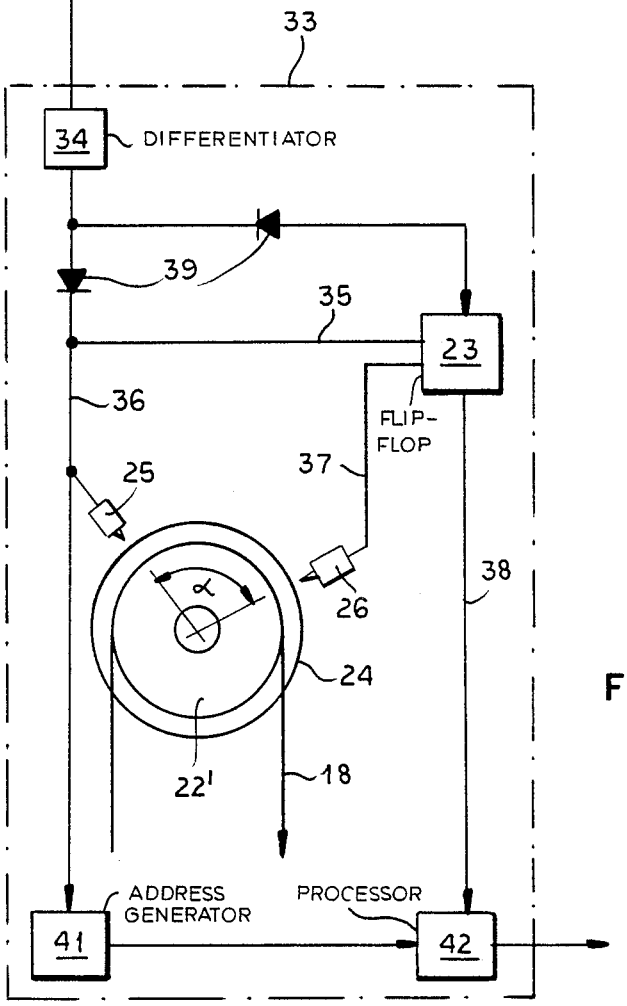
FIG. 9 is a schematic elevation showing the electronic components of the apparatus.

From FIG. 9 it will be apparent that the signal of a light curtain 10 can be delivered by one of the contact rails 19 or 20 to a central evaluation unit 33. In the latter, each interruption signal is transformed in differentiator 34 such that the rising flank of the signal is converted into a short positive current pulse 40 and the trailing flank of this signal into a short negative current pulse 50 (FIG. 10).

The positive pulse 40 applied by the conductor 35 through a corresponding rectifier diode to a flip-flop 23 closes a switch thereof. Simultaneously the pulse is applied to a magnetic head 25 applying a magnetic marking to the magnetic storage disk 24 rotating synchronously with the belt 18 and its drive wheel 22'.

After a rotation of the drive wheel 22' through an angle $\alpha$ which corresponds to the diameter of a supply spool plus the thickness of one winding layer of roving thereon, the marking is detected from the disk 24 as an echo pulse by a reading head 26 and via the conductor 37 opens the flip-flop 23.

The negative pulse 50 corresponding to the trailing flank of the light interruption can thus only pass through the flip-flop 23 when it arrives before the opening signal arrives from the reading head 26 at the flip-flop, i.e. only when the light curtain interruption corresponds to a displacement of the light curtain which is shorter than the diameter of the supply spool core plus one roving winding layer thereon, i.e. when the spool is considered to be empty. When the negative pulse passes the flip-flop 23, a signal is generated at the conductor 38 to initiate replacement of the empty spool or a group of such spools.

Diodes 39 selectively apply the positive and negative pulses 40 and 50 to the terminals of the flip-flop or the magnetic head 25. Each positive pulse, moreover, also advances an address former 41 to generate an address corresponding to the spool being monitored, the output of the address generator 41 being combined at 2 in a processor with the pulse from conductor 38 to insure that the correct spool will be replaced.

The elements 24–26 used to effectively establish the minimum permissible diameter of a spool before replacement occurs can also be formed as a digital memory with a shift register. The rotation of the wheel 22' can thus generate pulses which are counted. This use of the digital counter is of course analogous to the displacement measure provided by the device described and thus need not be discussed in greater detail herein.

Figure 11:
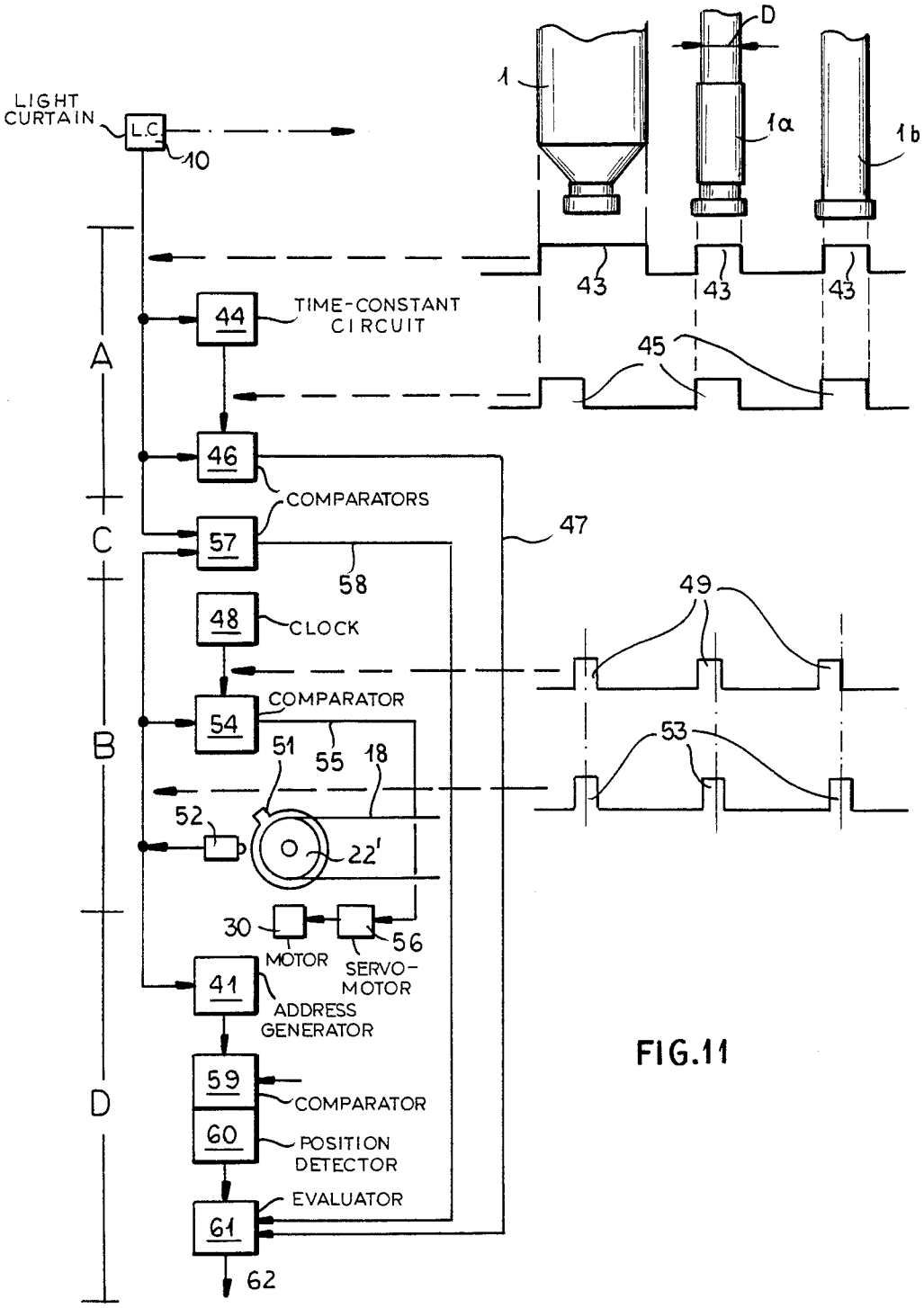
FIG. 11 is a combination block diagram, elevation and pulse diagram illustrating principles of operation of the apparatus of the invention.

FIG. 11 shows another embodiment for generating the spool change signal. At the left hand side of this Figure, the circuitry has been illustrated in the form of a block diagram while the right-hand portion of the Figure shows the effect of the signals and pulses for the respective spools, the graphs being pulse diagrams. The Section A of the device serves to generate the supply-spool-change command.

The light curtain 10 generates signals 43, 43, 43'' for a full spool 1, a spool 1*a* just about to be emptied and an empty spool 1*b*. The rising flanks of the signals 43, 43', 43'' generate in a pulse shaper or time-constant circuit 44 signals 45 of identical duration which signal the point at which the displacement of the light curtain through a distance equal to the diameter D of an empty spool core plus one winding layer is to be ascertained.

In the comparator 46, the actual duration of the signals 43, 43', 43'' with the fixed duration signals 45, representing the set point level, is compared, and when a signal is shorter than the signal 45 as shown for the signal 43'' for the spool 1*b*, a spool change signal is generated at line 47.

The section B serves to control the speed of the light curtain 10 for automic synchronization. The correctness of the comparison mentioned above requires that the speed at which the light curtain 10 is moved by the belt 18 bear the correct relationship to the signals 45 generated by the time constant circuit 44. Slip would be detrimental. As a consequence, the clock 48 generates a pulse 49 at a time interval which is equal to the time interval at which the light curtain 10 should pass between spools when the signals 45 are generated and the interruption is the diameter of the empty spool sleeve plus one winding layer.

The drive wheel 22' for the belt 18 is provided with a cam 51 cooperating with switch 52 to generate pulses 53 applied to the comparator 54. When the pulse 53 does not coincide with the pulse 49, the comparator 54 applies an error signal via the conductor 55 to the servo-control 56 to accelerate or decelerate the motor 30 driving the wheel 22'. The synchronization is thus determined by the time standard afforded by the clock 48.

Section C of the circuit monitors for absent supply spools.

When a supply spool is not present, the corresponding signal 43, 43', 43'' is not generated and thus the pulse 53 applied to the comparator 57 in the absence of a pulse 43, 43', 43'', generates at the conductor 58 an absent-spool signal.

The section D of the circuit is an evaluation network.

Each pulse 53 advances the address generator 41 by one address. The addresses are compared with fixed position addresses for the start, end or middle spindles of a row and a position detector 60 which can be a microcomputer generates an output representing the precise position monitored by the light curtain at any point in time.

In the evaluator 61, the command from conductors 47 and 58 are combined with the position signal from element 60 and the instruction applied via a conductor 62 to signal the necessary operation. The latter operation can include signalling, service personnel or an operator, triggering a spool change or the like. This system can be modified by having the pulses 49 generated also by the cam 51, and of a duration equal to the effective length thereof.

Then the pulses 59 can be formed by the leading flank of the signal 43 . . . . With the process of the invention, the diameters of the spools 1, 2 are repetitively monitored in succession and the detected diameter compared with a minimum permissible diameter so that the spool change can be effected when a detected diameter falls below this minimum.

We claim:

1. A method of detecting the degree of filling of supply spools arranged in rows in a spinning or twisting frame, comprising the steps of:

repetitively sensing the diameters of the spool of each row in succession by entraining a respective light curtain for each row continuously back and forth along each of said rows at a given speed with respective flexible elements extending along each of said rows and having a common drive so that said spools of each row interrupt the respective light curtain and detecting an interval of light interruption by each spool;

upon each sensing of the diameter of each of said spools, comparing an actual interruption interval of a light curtain related to an actual diameter and the degree of filling with a preset value corresponding to the diameter of an empty spool plus one winding layer; and generating a signal representing the need to replace a given spool in response to the comparison of the diameter sensed with said preset value, when said actual interruption interval is shorter than said preset value.

2. The method defined in claim 1 wherein the diameters of said spools are measured by comparison of said actual diameters with a preset value of a degree of displacement of said light curtain during each interruption.

3. The method defined in claim 1 wherein the diameters of said spools are measured by detecting a duration of each interruption at a given speed of light curtain past each spool.

4. A device for detecting the degree of filling of supply spools rotatable about respective axes of rotation and arranged in a number of parallel rows on a twisting or spinning frame, said device comprising:

flexible transport elements extending along each of said rows;

a common drive for all said elements moving each of said flexible transport elements back and forth along the respective row;

a respective light curtain for each row detecting the diameter of said spool of a respective row, carried by respective ones of said flexible transport elements, perpendicular to said axes and positioned so as to be interrupted by each of said supply spools of the respective row in succession, each of said light curtains comprising:

a light source lying along one side of the respective row;

a photocell positioned on the other side of the respective row so as to be directly opposed to said source; and a yoke connecting each photocell and the respective source and sliding along a stationary rail extending along the respective row;

a pair of contact rails insulated one from another and electrically conducted, said contact rails supplying light curtain with electrical energy;

means connecting for comparing the diameter of each of said spools connected to said light curtains with a preset minimum diameter value; and means for generating a signal representing the need to replace a given spool in response to a comparison connected to said means for comparing a respective one of said sensed diameters falls below said preset value.

5. The device defined in claim 4 wherein said means for comparing further comprises a time-constant circuit and generating signals of identical duration, said signals of identical duration indicate a preset duration of a displacement of said light curtains during an interruption at a distance equal to the diameter of an empty spool plus one winding layer.

6. The device defined in claim 4 wherein said means for comparing further comprising means for transmitting electrical signals.

7. The device defined in claim 5 wherein said means for comparing further comprises a timing circuit connected to said time-constant circuit for detecting an actual duration of said interruptions and each signal of said actual duration and each signal of said actual duration being compared with said signal of identical duration, is transmitted by said means for transmitting to said means for generating a signal representing the need of a replacement of any given spool, if said actual duration is shorter than said identical duration.

8. The device defined in claim 4 wherein said means for comparing further comprises circuit means for necessary measuring the displacement of said light curtain during each of said interruptions.

9. The device defined in claim 8 wherein said means for measuring further comprises a flip-flop, said flip-flop being connected to said light curtain and to said means for measuring and being opened when any of said interruption generate a pulse related to said displacements when said displacement is shorter than said preset diameter value, said flip-flop being closed when said displacement is longer than said preset diameter.

10. The device defined in claim 7 wherein said means for generating a signal of said replacement comprising:

an address generator receiving said signal of actual duration and stepping upon receipt by one address;

a comparator connected to said address generator and comparing said address with the fixed position addresses related to start, end or middle spool of each of said rows; and a microcomputer representing the precise position of each spool be interrupted.

11. The device defined in claim 4 wherein said flexible transport elements are form-locked together and pass around a wheel of said drive.

12. The device defined in claim 11 wherein said flexible transport elements are perforated and said wheel has pins passing through.

13. The device defined in claim 11 wherein said wheel has a cam generating a pulse which is applied to said means for comparing.

14. The device defined in claim 12 wherein said means for comparing further comprising a speed control circuit for controlling the speed of said flexible transport elements, said circuit generating a time-constant signal compared with said pulse, produced by said cam, indicating the actual speed.

* * * * *